US009382059B2

(12) United States Patent
Selinger et al.

(10) Patent No.: US 9,382,059 B2
(45) Date of Patent: Jul. 5, 2016

(54) SPRAY HEAD

(75) Inventors: Andrea Selinger, Luebeck (DE); Norman Goldberg, Schwerin (DE)

(73) Assignee: LINDAL Dispenser GmbH, Schoenberg (DE)

( * ) Notice: Subject to any disclaimer, the term of this patent is extended or adjusted under 35 U.S.C. 154(b) by 0 days.

(21) Appl. No.: 13/979,285

(22) PCT Filed: Jan. 19, 2012

(86) PCT No.: PCT/DE2012/100012

§ 371 (c)(1), (2), (4) Date: Aug. 20, 2013

(87) PCT Pub. No.: WO2012/097809

PCT Pub. Date: Jul. 26, 2012

(65) Prior Publication Data

US 2013/0320041 A1 Dec. 5, 2013

Related U.S. Application Data

(60) Provisional application No. 61/465,894, filed on Mar. 25, 2011.

(30) Foreign Application Priority Data

Jan. 21, 2011 (DE) ..... 20 2011 000 160 U

(51) Int. Cl.
*B65D 83/22* (2006.01)
*B65D 83/20* (2006.01)
(Continued)

(52) U.S. Cl.
CPC ..... *B65D 83/22* (2013.01); *B65D 83/206* (2013.01); *B65D 83/345* (2013.01); *B65D 83/56* (2013.01); *B05B 11/0029* (2013.01)

(58) Field of Classification Search
CPC .. B65D 83/205; B65D 83/222; B65D 83/206; B65D 83/46; B65D 83/345; B65D 83/22; B65D 83/56; B65D 11/0029
USPC ..... 222/402.12, 153.11, 153.13, 182, 517, 222/402.13, 402.11; 220/282, 283
See application file for complete search history.

(56) References Cited

U.S. PATENT DOCUMENTS 3,138,331 A * 6/1964 Kutik ..... 239/337
3,323,695 A 6/1967 Monahon
(Continued)

FOREIGN PATENT DOCUMENTS

CA 2130580 A1 8/1993
DE 43 90 810 T1 2/1995
(Continued)

OTHER PUBLICATIONS

International Search Report of PCT/DE2012/100012, date of mailing Jun. 27, 2013.

*Primary Examiner* — Kevin P Shaver
*Assistant Examiner* — Robert Nichols, II
(74) *Attorney, Agent, or Firm* — Collard & Roe, P.C.

(57) ABSTRACT

A spray head for dispensing product from a container, has an attachment element on which a closure element for closing off the exit orifice of a spray channel is disposed and an actuating element on activation of which the exit orifice is connectable with a valve opening of the container. In order to create a spray head which is easier and safer to handle, it is proposed that the closure element and the actuating element form a unit pivotable about an axis from a closed position to an actuating position, the exit orifice of the spray channel being closable by the unit's being in the closed position, and that the unit has locking means via which the unit can be locked in the closed position.

5 Claims, 3 Drawing Sheets

Figure 1A:
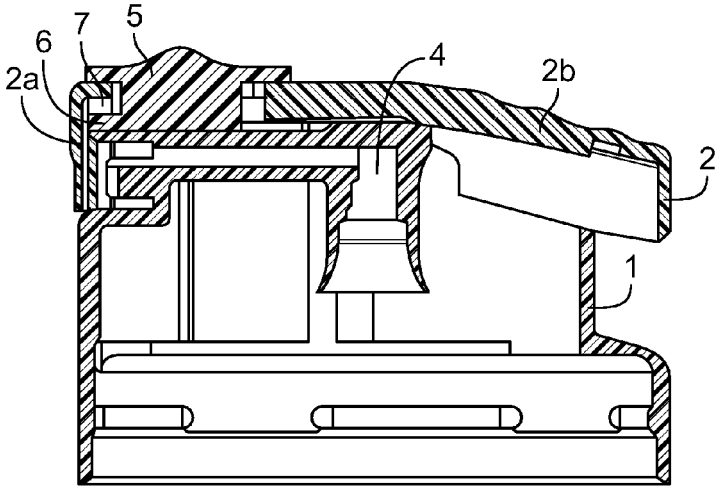

(51) Int. Cl.

| | |
|---|---|
| ***B65D 83/34*** | (2006.01) |
| ***B65D 83/56*** | (2006.01) |
| *B05B 11/00* | (2006.01) |

(56) References Cited

U.S. PATENT DOCUMENTS

| | | | | |
|---|---|---|---|---|
| 3,410,461 | A | 11/1968 | Baker | |
| 3,510,029 | A * | 5/1970 | Doyle | 222/402.12 |
| 4,776,496 | A * | 10/1988 | Battegazzore | 222/209 |
| 4,815,541 | A * | 3/1989 | Arrington | 169/74 |
| 5,105,988 | A * | 4/1992 | Knickerbocker | 222/148 |
| 6,908,017 | B2 * | 6/2005 | Mineau et al. | 222/402.13 |
| 8,616,416 | B2 * | 12/2013 | Jordan | 222/402.12 |
| 2002/0008119 | A1 | 1/2002 | Clark et al. | |

FOREIGN PATENT DOCUMENTS

| | | | |
|---|---|---|---|
| DE | 203 08 449 | U1 | 10/2004 |
| EP | 0 558 810 | A1 | 9/1993 |
| FR | 2 933 678 | A1 | 1/2010 |
| WO | WO 89/03363 | A1 | 4/1989 |

* cited by examiner

SPRAY HEAD

CROSS REFERENCE TO RELATED APPLICATIONS

This application is the National Stage of PCT/DE2012/100012 filed on Jan. 19, 2012, which claims priority under 35 U.S.C. §119 of German Application No. 20 2011 000 160.1 filed on Jan. 21, 2011 and under 35 U.S.C. §119(e) of U.S. Provisional Application No. 61/465,894, the disclosures of which is incorporated by reference. The international application under PCT article 21(2) was not published in English.

This invention relates to a spray head for dispensing product from a container, having an attachment element on which a closure element for closing off the exit orifice of a spray channel is disposed and an actuating element on activation of which the exit orifice is connectable with a valve opening of the container.

Numerous products, in particular cosmetics and foodstuffs, are offered in containers from which they are dispensed, for example, in the form of foam or gel. These containers are usually pressurised containers.

The DE 203 08 449 U1 discloses a spray head for foams or gels, which has an attachment element to which a closure element is hinged. This spray head comprises an actuating element which is movably mounted in the attachment element and which has an exit orifice and a pressure section, said exit orifice being connectable via a connecting piece with a valve opening of the container and said valve being actuated via the pressure section, and the closure element, when in its closed position, closing off the exit orifice. The closure element and the actuating element form a locking device which prevents the actuating element from being pressed when the closure element is in a closed position.

The U.S. Pat. No. 3,410,461 describes an aerosol valve in which the exit orifice closes automatically by way of a spherical element with an ejection orifice.

The U.S. Pat. No. 3,323,695 A describes an actuating device for a pressurised dispenser fitted with a valve, having means to prevent undesired product discharge and/or contamination of the product contained in the dispenser.

An actuating mechanism is known from the US 2002/008119 A1, which has means for blocking actuation of the valve.

The DE 43 90 810 T1 describes a childproof nozzle for a hand sprayer.

The object of the invention is to create a spray head which is easier and safer to handle than prior art spray heads.

This object is established in that the closure element and the actuating element form a unit pivotable about an axis from a closed position to an actuating position, the exit orifice of the spray channel being closable by the unit's being in the closed position, and that the unit has locking means via which the unit can be locked in the closed position.

In the DE 203 08 449 U1, the closure element is hinged to the attachment element like a cap and has to be opened before the actuating element can be pressed; in this invention, by contrast, the closure element, which forms a unit with the actuating element, is swiveled into the actuating position when the actuating element is activated, thus freeing the exit orifice of the spray channel. On termination of product dispensation, the unit swings back into the closed position, closing off the exit orifice of the spray channel again. Another difference compared to the DE 203 08 449 U1 consists in that there, the closure element and the actuating element form a locking device that prevents the actuating element from being pressed when the closure element is in the closed position, whereas according to this invention, moving the unit into the closed position closes off the exit orifice of the spray channel.

By way of a locking means preferably provided on the upper surface of the unit comprising the closure element and the actuating element, the unit may be locked in the closed position or moved into the actuating position. The locking means and the actuating element may both be activated with one and the same hand, allowing single-handed operation of the device. A covering cap is therefore unnecessary, because a locking means to prevent accidental activation of the actuating element is provided. A synergistic effect is obtained precisely through the interaction of the unit, which is pivotable about an axis from a closed position to an actuating position, with the locking means, which locks the unit in the closed position, in which the exit orifice of the spray channel is closed off.

A preferred embodiment of the invention consists in that, on its underside, the locking means has a connecting member which, in the closed position, is connectable in form-fitting manner with the attachment element.

It is within the scope of the invention to configure the locking means as a button, preferably a press or sliding button.

A sliding button is in so far advantageous that there is no danger of the button being moved into the actuating position by vertical pressure exertion.

In this way, the unit comprising the closure element and the actuating element is connected in form-fitting manner with the attachment element, preventing the unit from swiveling into the actuating position. When the button is actuated anew, the form-fitting connection disengages again, allowing the unit to be swiveled into the actuating position.

Lastly, it is expedient for the button to feature a profile on its upper surface.

Typical embodiment of the invention is discussed in more detail below on the basis of drawings.

The drawing in

Figure 1B:
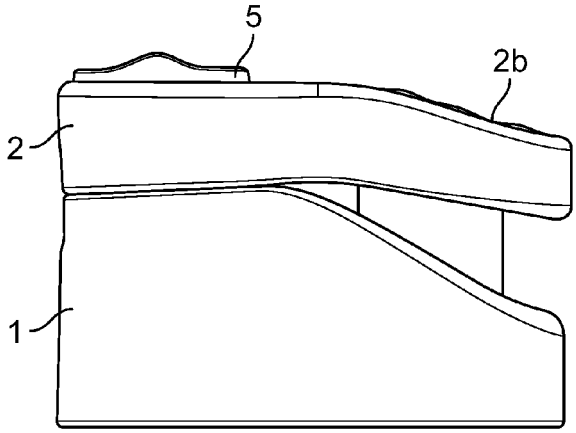
Figure 1C:
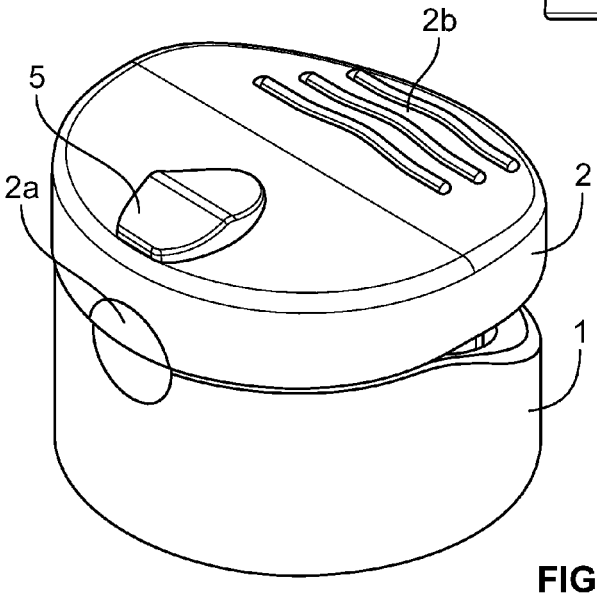
Figure 2A:
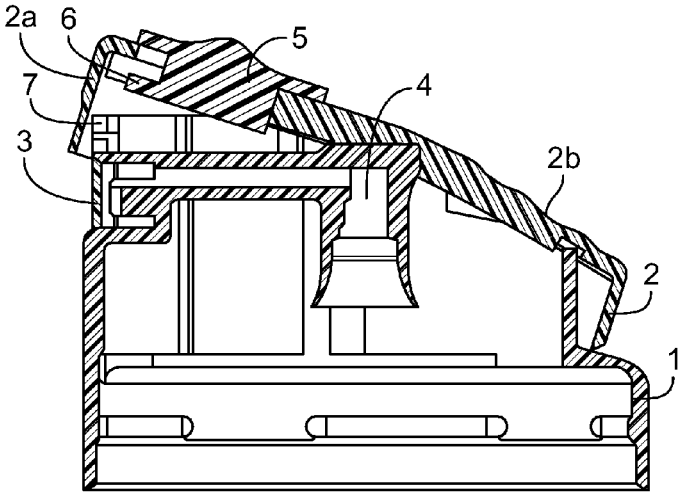
Figure 2B:
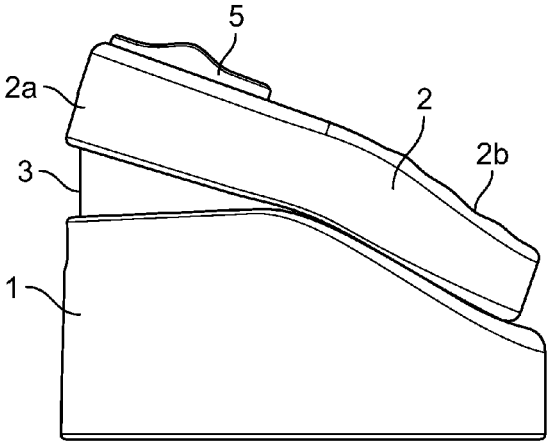
Figure 2C:
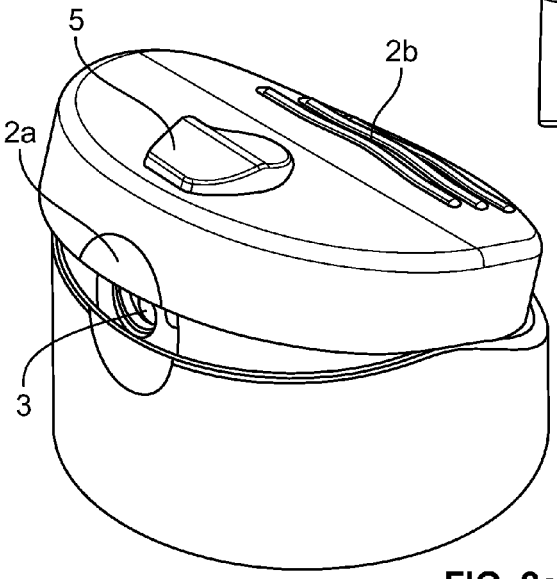
Figure 3A:
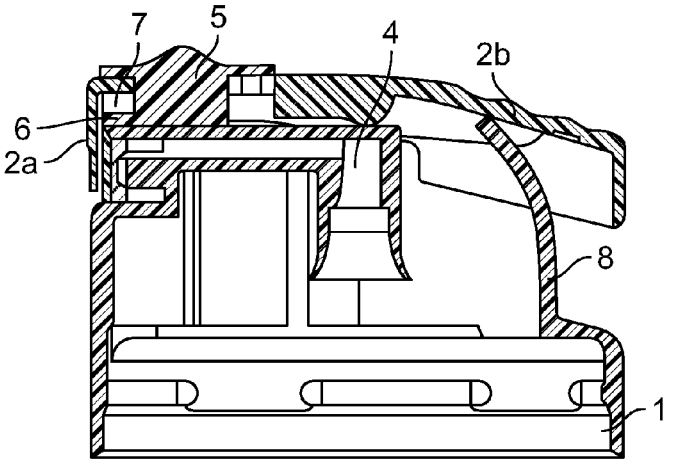
Figure 3B:
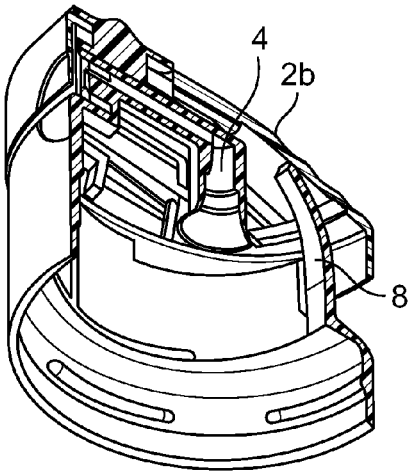
Figure 3C:
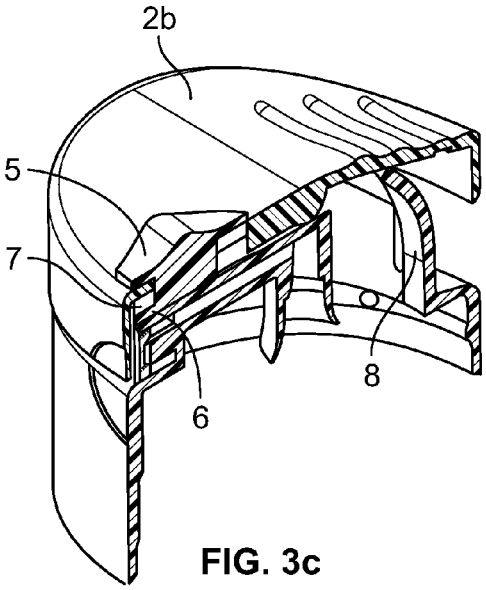

FIG. 1*a* shows a cut view of a spray head according to the invention, in the closed position;

FIG. 1*b* shows a side view of the spray head according to the invention, in the closed position;

FIG. 1*c* shows a perspective view of a spray head according to the invention, in the closed position;

FIG. 2*a* shows a cut view of a spray head according to the invention, in the actuating position;

FIG. 2*b* shows a side view of the spray head according to the invention, in the actuating position;

FIG. 2*c* shows a perspective view of a spray head according to the invention, in the actuating position;

FIGS. 3*a*, 3*b* and 3*c* show three views of a spray head according to the invention, having a reset means.

As is evident from FIGS. 1*a* to 2*c*, the spray head according to the invention has an attachment element 1 for attachment to a container, on which a unit 2 is mounted that can be swiveled about an axis from a closed position (FIGS. 1*a* to 1*c*) into an actuating position (FIGS. 2*a* to 2*c*). This unit 2 comprises a closure element 2*a* for closing off an exit orifice 3 of the spray channel, and an actuating element 2*b*, on actuation of which the exit orifice 3 is connectable via a channel 4 with the valve opening of the container. Pressure on the actuating element 2*b* simultaneously frees the exit orifice 3 and actuates the valve, allowing product to discharge from the container. When the actuating element 2*b* is let go, the unit automatically swivels back into the closed position, in which the exit orifice 3 of the spray channel is closed off again. In addition, a sealing element may be provided, for example by way of injection, on the inside of the closure element 2*a* for closing off the exit orifice 3 of the spray channel or on the attachment element 1 around the spray channel 3. The sealing element offers additional protection against penetration of oxygen and other undesired impurities (e.g. sand) and prevents the product from drying out, curing/hardening or oxidizing. This sealing element also offers protection against after-foaming of the product.

The unit 2 has locking means 5 in the form of a button 5, which is configured here as a sliding button on the upper surface of the unit 2. The unit 2 can be locked in the closed position via this button 5. To this end, the button 5 has a projection 6 on its underside, which, in a first end position of the button 5 (here the forward end, where the exit orifice is located) engages behind an element 7 of the attachment element 1. In this way the button 5, and with it the unit 2, is connected in form-fitting manner with the attachment element 1, thus preventing the unit 2 from swiveling into the actuating position. Provision may be made for a tamper-evident closure which secures the unit 2 in this position prior to initial use of the spray head. This may be achieved in that the button 5 or the unit 2 is locked in the closed position by the tamper-evident closure, which has to be destroyed prior to initial actuation. It is thereby ensured that the customer receives a still unused product.

When the button 5 is moved into the second end position (hear the rearward end, i.e. away from the exit orifice), the form-fitting connection disengages again, allowing the unit 2 to be swiveled into the actuating position.

To ensure a secure finger-hold on the button 5, the button 5, as also the actuating element 2*b*, may feature a profile on its upper surface.

Instead of the sliding button 5, other locking means 5 may also be envisaged, for example a rotary closure. This may, for example, like the sliding button 5, be disposed on the upper surface of unit 2 and have, for example, a slot into which a screw driver may be introduced to turn the rotary element from the closed position into the actuating position. A rotary closure configured in this way can serve simultaneously as a tamper-evident closure. Alternatively, the rotary closure may be arranged as a rotary ring on the outside of the attachment element 1. It is furthermore possible to provide for a sliding closure, or slider, which may also be disposed on the upper surface of the unit 2 or on the outside of the attachment element 1 and which can be pushed from a closed position into an actuating position. In the locked position, both the rotary ring and the slider would prevent the unit 2 from being moved downwards.

As is evident from FIGS. 3*a* to 3*c*, a reset element 8 may be provided for returning the unit 2 to its closed position. In the embodiment illustrated, the reset element 8 is engineered as a plastic spring 8, which is mounted on the attachment element 1 and which presses on the underside of the unit 2. Exertion of pressure on the actuating element 2*b* in order to connect the exit orifice 3 with the valve opening of the container tensions the reset element 8. When the actuating element 2*b* is let go, the reset spring 8 then presses the unit 2 back into its starting position, the closed position.

Lastly, it is also possible to coat those areas of the spray head through which the product passes with silver ions, so that, by virtue of their antibacterial effect, the discharging product is protected from bacteria.

The device according to the invention is particularly suitable for

- viscous products subject to after-leakage or after-foaming, such as gels and foams,
- light- and air-sensitive products, which must always be closed off again immediately after use, such as oils, food, cosmetics, paints and coating agents, waxes, spray-on plasters, spray-on adhesives, pharmaceutical products and hairsprays,
- products that are used out-of-doors during leisure time and are therefore exposed to dirt, such as sunscreening agents (whose nozzle must be protected from sand), deodorants and shampoos (which must be prevented from leaking, for example into sports bags) and hairsprays (to prevent accidental actuation in handbags),
- water-based sprays or solvents that are apt to dry out,
- viscous products with slow flow rates, which are difficult to discharge and distribute.

The invention claimed is:

1. A spray head for dispensing product from a container, having

- a spray channel with an exit orifice (3),
- an attachment element (1) on which a closure element (2*a*) for closing off the exit orifice (3) of the spray channel is disposed and
- an actuating element (2*b*) on activation of which the exit orifice (3) is connectable with a valve opening of the container via the spray channel (4),
- wherein the closure element (2*a*) and the actuating element (2*b*) form a unit (2) pivotable about an axis from a closed position to an actuating position, the exit orifice (3) of the spray channel being closable by the unit being in the closed position, and
- wherein the unit (2) has locking means (5) via which the unit (2) can be locked in the closed position, the locking means (5) is configured as a button (5) which is configured as a sliding button on an upper surface of the unit (2) and which has a projection (6) on its underside, which, in a first end position of the button (5) engages behind an element (7) of the attachment element (1), thus preventing the unit (2) from swiveling into the actuating position.

2. A spray head according to claim 1, wherein, on its underside, the locking means (5) has a connecting member, which, in the closed position, is connectable in form-fitting manner with the attachment element (1).

3. A spray head according to claim 1, wherein the button (5) features a profile on its upper surface.

4. A spray head according to claim 1, wherein a reset means (8) is provided for returning the unit (2) from the actuating position to the closed position.

5. A spray head according to claim 4, wherein the reset means (8) is engineered as a plastic spring (8), which is mounted on the attachment element (1) and which presses on the unit (2).

* * * * *